US005489222A

United States Patent [19]

Moyer et al.

[11] Patent Number: 5,489,222

[45] Date of Patent: Feb. 6, 1996

[54] MINI CONNECTOR WITH ANTI-ROTATIONAL CONTACT

[75] Inventors: William P. Moyer, Middletown; David W. Rupnik, Shiremanstown, both of Pa.

[73] Assignee: The Whitaker Corporation, Wilmington, Del.

[21] Appl. No.: 303,898

[22] Filed: Sep. 9, 1994

[51] Int. Cl.[6] ..... H01R 13/432

[52] U.S. Cl. ..... 439/748; 439/246; 439/578

[58] Field of Search ..... 439/246, 252, 439/578, 733.1, 746–749

[56] References Cited

U.S. PATENT DOCUMENTS 3,980,385 9/1976 Hirokawa et al. ..... 439/748

4,169,651 10/1979 Hanke ..... 439/746

*Primary Examiner*—Gary F. Paumen

[57] ABSTRACT

A miniature bulkhead connector (10) is disclosed having a novel anti-rotational mechanism for preventing rotation of the center conductor (90) during mating with a mating connector. The connector includes a metal housing (14) arranged to be mounted to a bulkhead (20) and an insulating insert (40) in a cavity (38) within the housing. The insert (40) has a central hole (54) therethrough on the longitudinal axis (43) of the insert. A series of ribs (62) are formed on the interior surface of the central hole (54) parallel with the axis and are arranged to form channels (64) between adjacent ribs. the channels (64) are sized to receive edges (94) that project from opposite sides of the contact (56). The edges (94) slide into the channels (64) allowing the contact to freely move along the longitudinal axis (43) but will not permit relative rotation thereof. Since there are a number of channels, there is a similar number of angular positions from which the contact may be inserted into the insulating insert.

7 Claims, 5 Drawing Sheets

MINI CONNECTOR WITH ANTI-ROTATIONAL CONTACT

The present invention relates to electrical connectors of the type that feed through a bulkhead and more particularly to an anti-rotational contact for such a connector.

BACKGROUND OF THE INVENTION

Bulkhead coaxial connectors typically have a connector housing that is attached to the bulkhead by means of screws that extend through a flange of the housing, or a nut that is threaded onto a threaded portion of the housing that extends through an opening in the bulkhead. The contact of the connector is crimped onto the center conductor of the coaxial cable in the usual manner. In any case, the connector typically has a reduced diameter portion that extends through the bulkhead and is threaded to receive a nut from a mating connector. During mating, as the nut is being turned, the contact of the mating connector may also turn thereby introducing torque to the contact of the bulkhead mounted connector. This torque may be sufficient to damage the crimped connection with the cable conductor and render the connector unreliable or completely inoperative. This is especially the case where the mating cable is the type having an integrally molded connector and nut, so that when the nut rotates, the connector and the cable rotate along with it. Anti-rotational mechanisms are known that include a pin or other projection that projects from the connector housing into a longitudinally formed slot in the contact. Such a structure is effective as an anti-rotational mechanism, however, when assembling the contact to the connector, it must be carefully aligned with the pin as it is being inserted. Since the contact is delicate care must be taken to prevent damage. This operation is usually performed by the end user, and as most cases where it is performed manually, it tends to be a substantial burden and adversely affects production.

What is needed is an anti-rotational mechanism for coaxial connector contacts that is easily assembled manually by the relatively unskilled worker.

SUMMARY OF THE INVENTION

An electrical bulkhead connector is disclosed having a housing adapted to be attached to a bulkhead. The housing has a cavity therein and an insulating insert in the cavity. The insert has a longitudinal axis and an opening therethrough substantially coaxial with the longitudinal axis. A contact, adapted to be connected to the conductor of a cable, is arranged to be received within the opening of the housing in any of a plurality of angular positions, in each of which the contact is inhibited from rotational movement with respect to the insert yet is free to move axially along the axis.

DESCRIPTION OF THE PREFERRED EMBODIMENT

Figure 1:
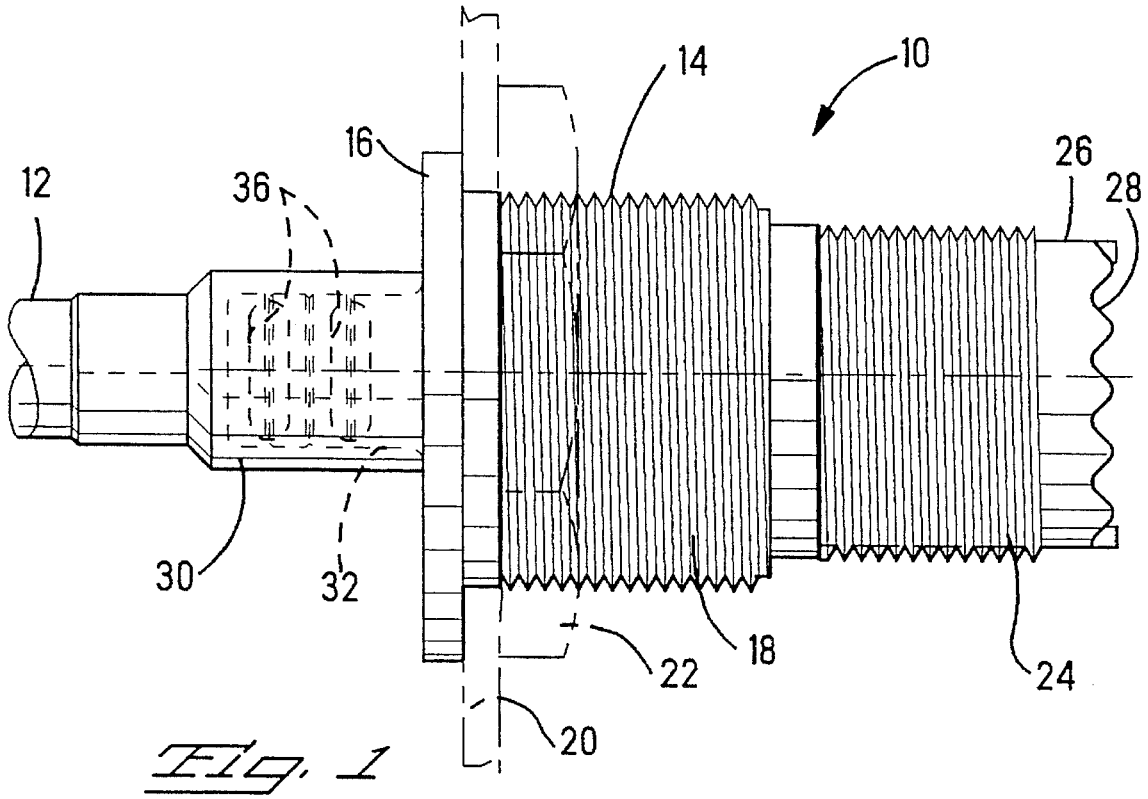
FIG. 1 is a side view of a connector incorporating the teachings of the present invention.
Figure 2:
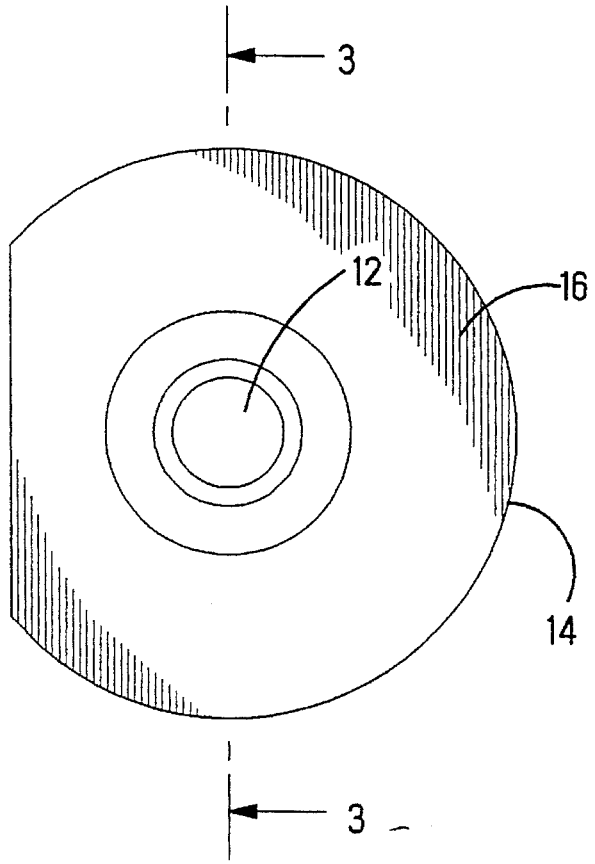
FIG. 2 is an end view of the connector shown in FIG. 1.
Figure 3:
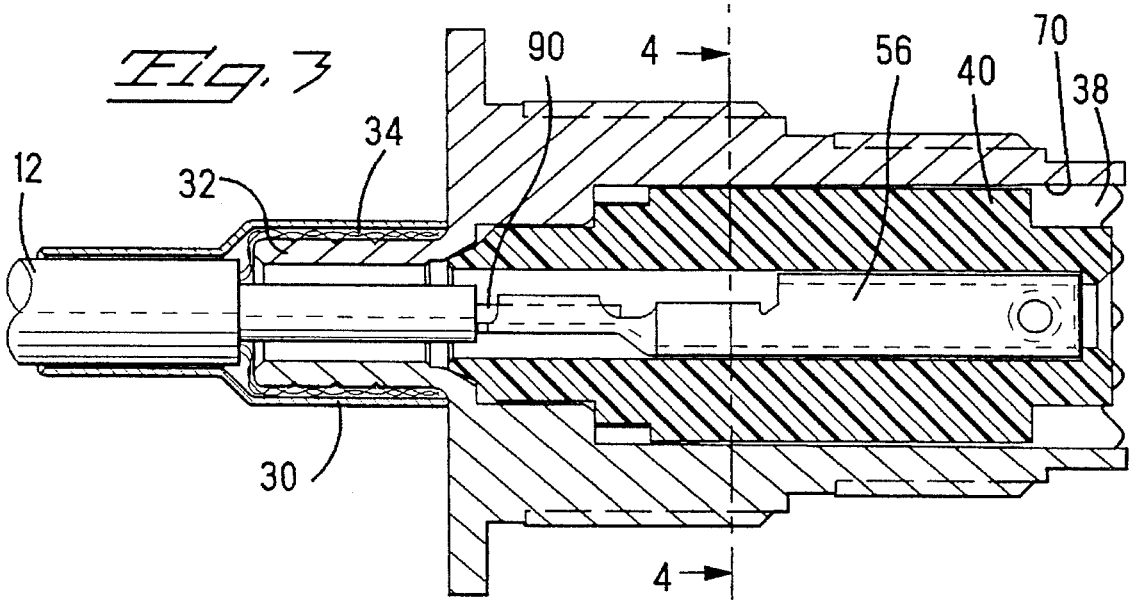
FIG. 3 is a cross-sectional view taken along the lines 3—3 in FIG. 2.

There is shown in FIGS. 1 and 2 a bulkhead connector 10 terminated to a coaxial cable 12. The connector 10 includes a metal housing 14, a mounting flange 16, and a first threaded diameter 18 extending from the flange. The connector 10 is mounted to a bulkhead 20, shown in phantom lines in FIG. 1, by passing the first threaded diameter 18 through a hole in the bulkhead and threading a nut 22, also shown in phantom lines, onto the diameter 18 so that the bulkhead is tightly sandwiched between the nut and the flange 16. A second threaded diameter 24 extends coaxially from the first threaded diameter 18 and is of smaller diameter and sized to receive an attaching nut from a mating connector, not shown, in the usual manner. The second threaded diameter 24 terminates in a shank end 26 having a scalloped edge 28 for a purpose that will be described. The opposite end of the connector 10 includes a ferrule 30 that is disposed over a small diameter projection 32 extending from the flange 16 in an opposite direction to the first and second threaded diameters. As best seen in FIG. 3, the outer insulating jacket of the cable 12 has been stripped back and the underlying shielding layer 34 expanded and disposed over the projection 32, between the ferrule and the projection. The ferrule has been crimped, as shown at 36 in FIG. 1, to electrically connect and physically secure the shielding layer 34 to the metal connector housing 14.

Figure 4:
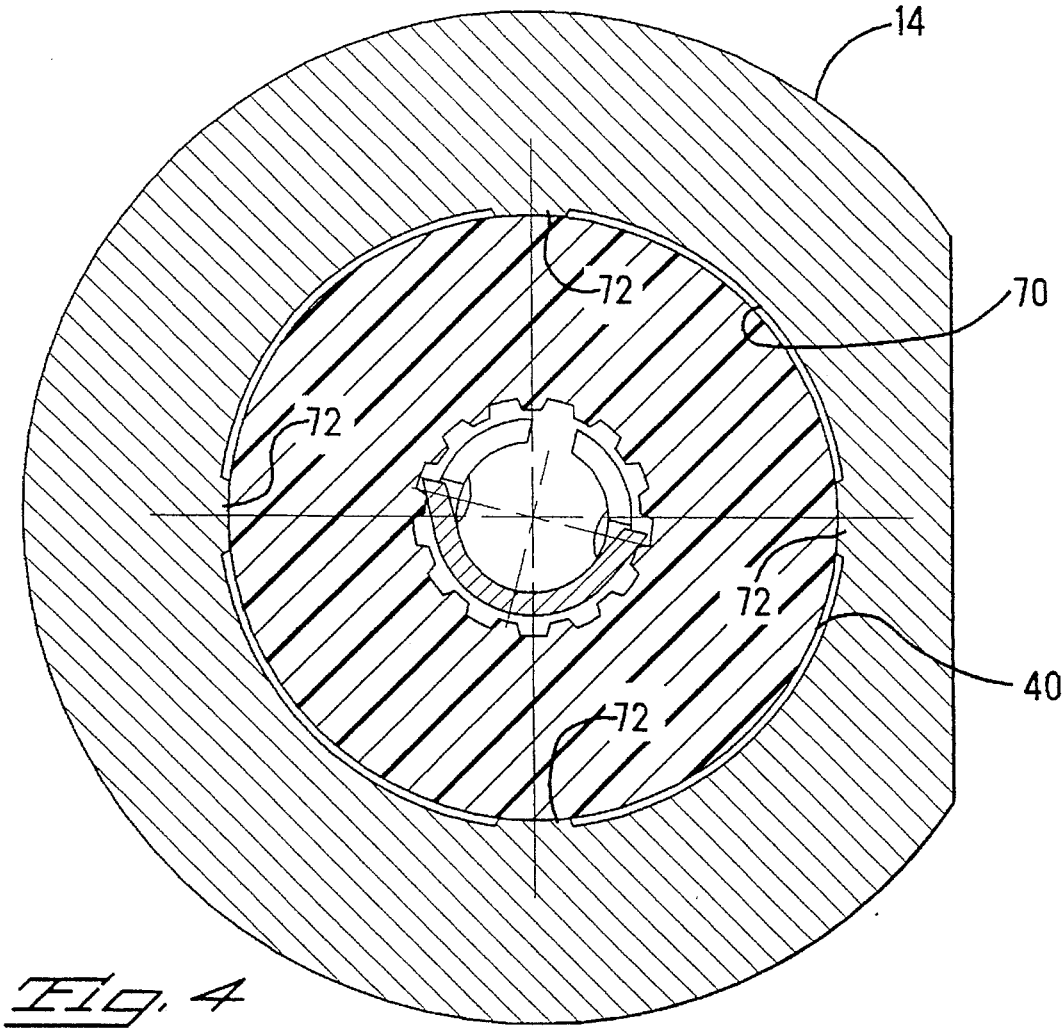
FIG. 4 is a cross-sectional view taken along the lines 4—4 in FIG. 3.
Figure 5:
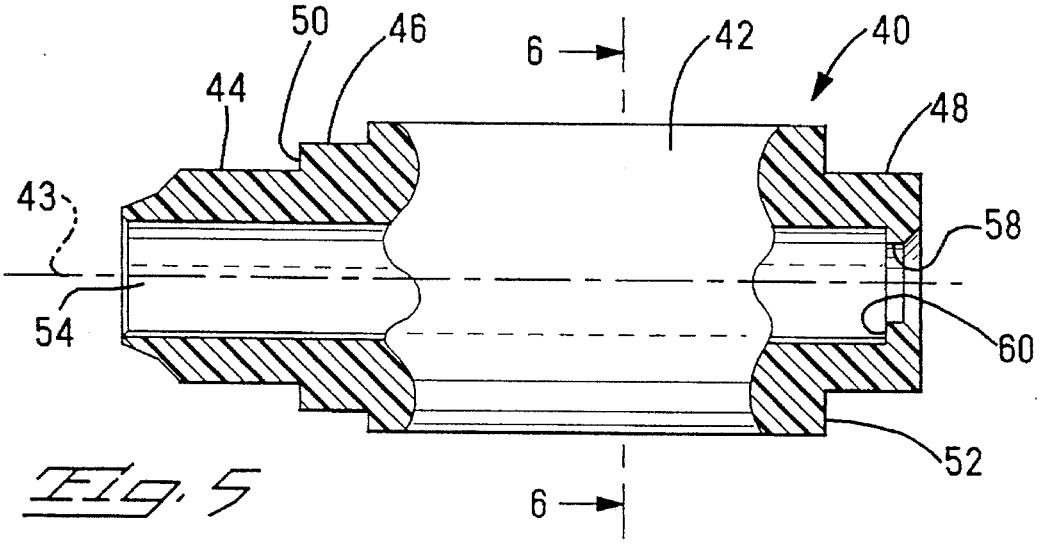
FIG. 5 is a partial cross-sectional view of the insulating insert shown in FIG. 3.
Figure 6:
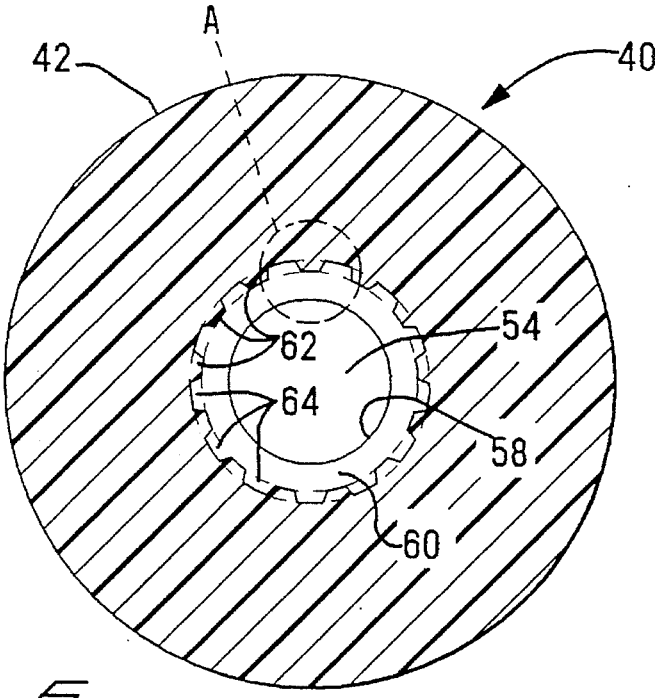
FIG. 6 is a cross-sectional view taken along the lines 6—6 in FIG. 5.
Figure 7:
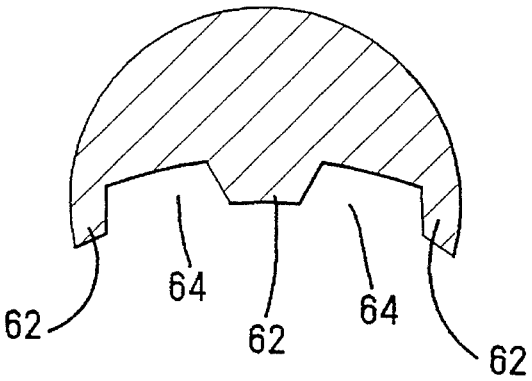
FIG. 7 is an enlarged view of a portion of the view shown in FIG. 6 and indicated at A.

As shown in FIGS. 3 and 4, the connector 10 includes an insulating insert 40 arranged within a cavity 38 in the connector housing 14. As best seen in FIGS. 5 and 6, The insert 40 is of somewhat cylindrical shape having a major outer diameter 42, a longitudinal axis 43, and three relief diameters 44, 46, and 48 that provide shoulders 50 and 52, for a purpose that will be described. A hole 54 is formed through the insert 40 concentric with the diameter 42. The hole 42 is sized to receive and guide an electrical contact 56, shown in FIG. 3, and has a reduced diameter portion 58 sized for receiving and guiding a pin contact on a mating connector, not shown. A shoulder 60 is formed by the reduced diameter 58 and serves to retain the contact 56 within the connector 10 when disconnecting the mating connector. As best seen in FIGS. 6 and 7, the hole 54 includes a plurality of ribs 62, running substantially the entire length of the hole, that extend radially into the hole a short distance thereby forming a channel 64 between each pair of adjacent ribs. The ribs 62 and associated channels 64 are equally spaced about the interior of the hole 54, substantially straight and parallel to the axis 43. As shown in FIGS. 3 and 4, the cavity 38 of the housing 14 includes an inner diameter 70 that is slightly larger than the outer diameter 42 of the insert 40, and four ribs 72 extending radially inwardly from the inner diameter to provide an interference fit with the outer diameter of the insert. This prevents rotation of the insert with respect to the housing during use. The shank end 26 is deformed, not shown, so that the scallops 28 are bent inwardly into interfering engagement with the relief diameter 48 to retain the insert within the cavity 38. Additionally, the shoulders 50 and 52 of the insert 40 are trapped within the inner diameter 70.

Figure 9:
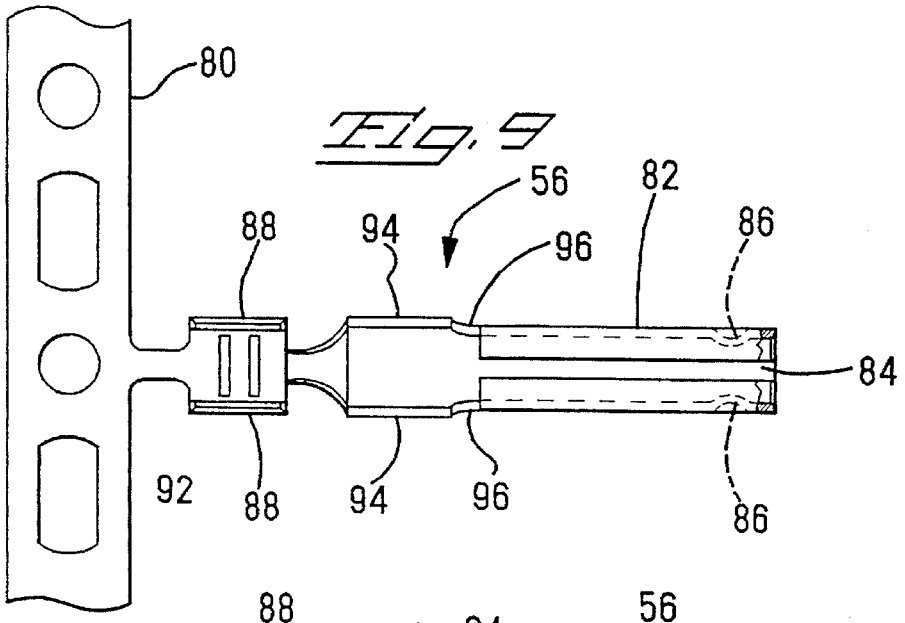
FIGS. 8 and 9 are side and top views, respectively, of the contact shown in FIG. 3.
Figure 8:
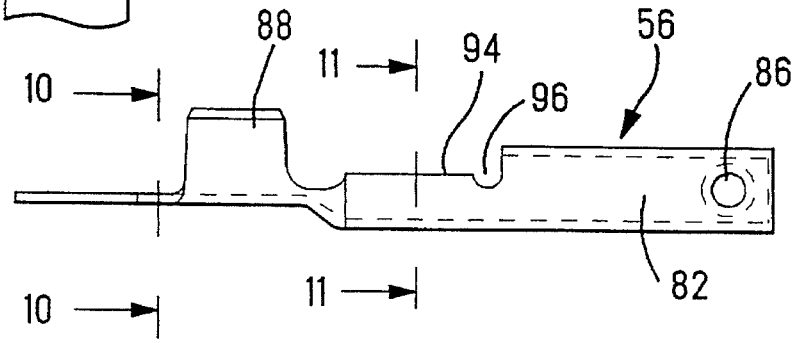
Figure 10:
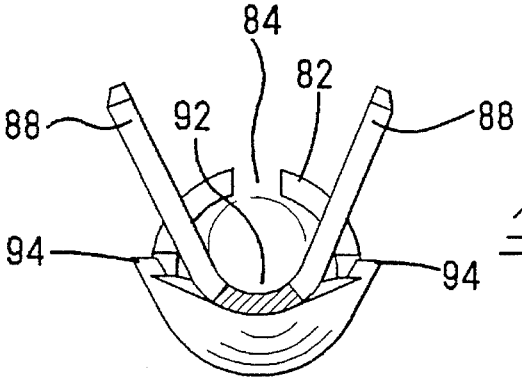
FIGS. 10 and 11 are cross-sectional views taken along the lines 10—10 and 11—11, respectively, in FIG. 8.
Figure 11:
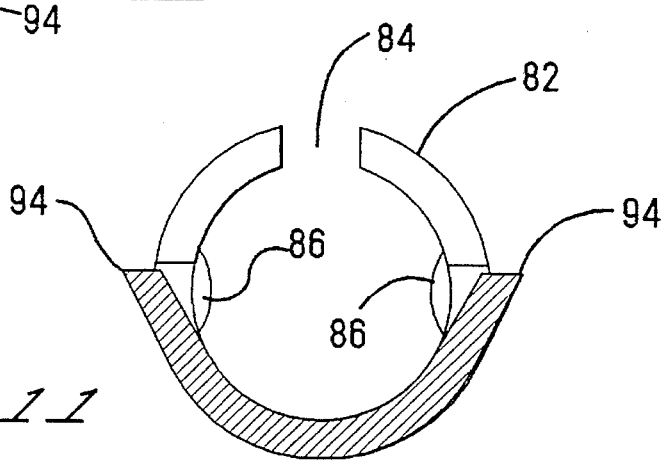

The contact 56, as best seen in FIGS. 8 through 11, is stamped and formed from strip stock and is on a carrier strip 80, in the usual manner. The receptacle contact 56 includes a cylindrically shaped barrel 82 having an upwardly facing slot 84 and a pair of oppositely formed dimples 86 that are arranged to electrically engage the surfaces of a pin contact, not shown, of a mating connector. A pair of crimping tabs 88 extend outwardly from a conductor nest 92 formed in the shank of the contact adjacent the carrier strip 80. During attachment of the contact 56 to a center conductor 90 of the cable 12 the contact is separated from the carrier strip 80, the conductor 90 positioned in the nest 92, and the crimping tabs 88 folded over the conductor and crimped in place in the usual manner. A pair of oppositely positioned edge portions 94 are formed between the contact barrel 82 and the crimping tabs 88, as best seen in FIGS. 8 and 9. The edge portions 94 are integrally formed with the contact barrel and crimping tabs and extend radially outwardly past the outer diameter of the contact barrel, as shown in FIGS. 10 and 11. A relief cutout 96 is provided between each edge 94 and the contact barrel 82. The outside diameter of the contact barrel is sized to slip into the hole 54 with a slight amount of lateral play. The edge portions 94 extend into two substantially opposite channels 64, as best seen in FIG. 4, and prevent rotation of the contact 56 with respect to the insert 40. The channels and end portions are sized so that the contact 56 can freely move axially within the hole 54 but cannot rotate with respect to the insert 40. There are thirteen channels 64 in the insert 40, in the present example. This permits insertion of the contact 56 into the hole 54 in any one of thirteen different angular positions, however, as the contact is inserted into the hole 54 the edge portions 94 need only align with any two substantially opposite channels 64. This greatly simplifies the manual insertion of the contact into the connector during assembly thereof. The worker need only insert the contact barrel into the hole 54 and slightly rotate the contact until the edge portions align with two of the channels and slide thereinto. The ribs 62 may be beveled at their ends opposite the reduced diameter 58 to facilitate entry of the end portions 94 into the channels 64.

Figure 12:
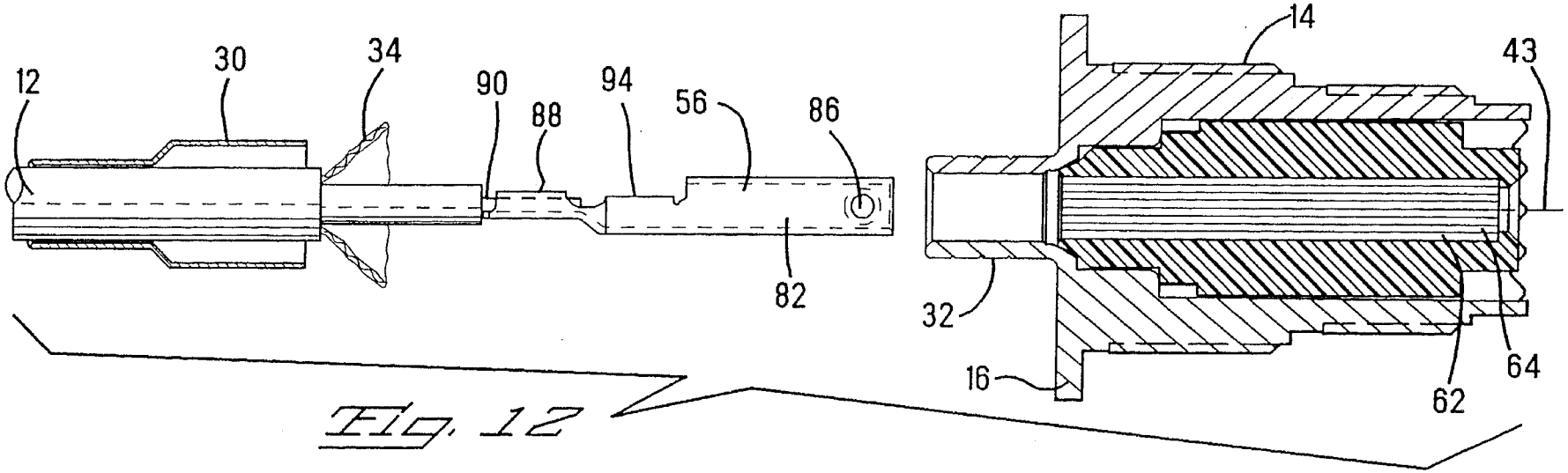
FIGS. 12 and 13 are partial cross-sectional views of the connector and cable shown in FIG. 1, showing two stages of assembly thereof.
Figure 13:
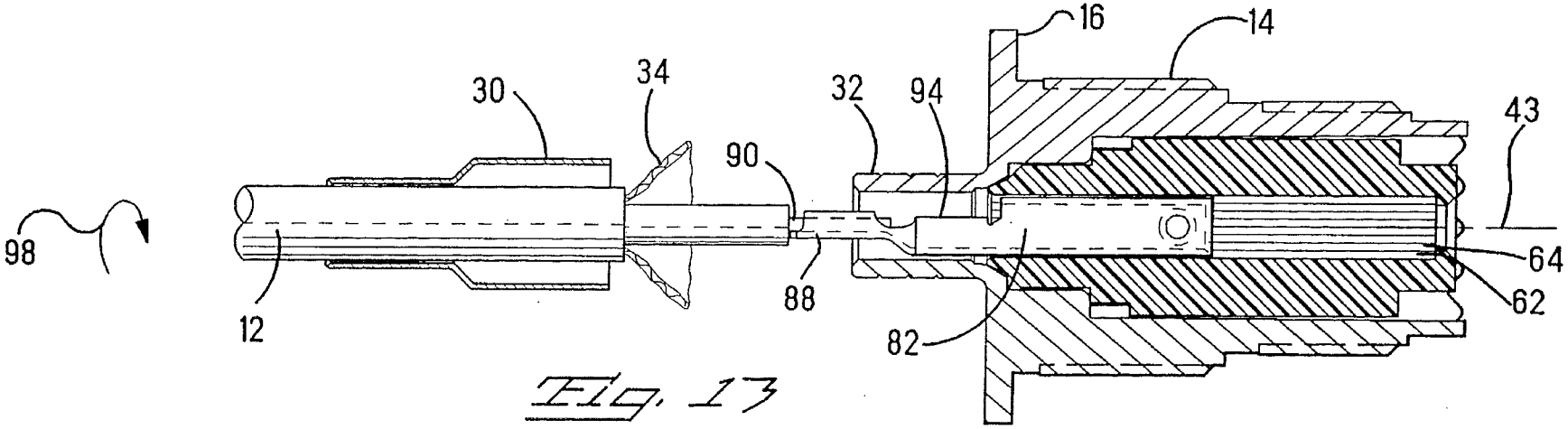

In operation, the cable 12 is stripped in the usual manner, and the contact 56 crimped onto the conductor. The ferrule 30 is slipped over the terminated end of the cable and the shielding expanded preparatory to assembling to the connector housing 14, as shown in FIG. 12. The axis of the cable 12 and attached contact is aligned with the axis 43 of the insert 40 and the contact barrel 82 inserted into the opening in the small diameter projection 32 and into the hole 54 in the insert 40. When the contact is inserted to the position shown in FIG. 13, the edge portions 94 are just about to enter into the channels 64 and may require a slight rotation, as indicated by the arrow 98 in FIG. 13, to align them so that insertion can continue. Insertion continues until the end of the contact barrel 82 engages the shoulder 60 of the insert 40, as shown in FIG. 3. The shield layer 34 is then arranged around the small diameter projection 32 and the ferrule 30 moved into position and crimped, thereby completing the assembly of the cable to the connector 10. The connector 10 can then be attached to the bulkhead 20 by means of the nut 22, as shown in FIG. 1 and as described above.

While the edge portions 94 are utilized to engage the channels 64, in the present example, other suitable features such as ribs or tabs projecting from the sides of the contact barrel or projecting from other parts of the contact may be advantageously utilized. The important requirement being that the features that engage the channels permit free axial movement of the contact within the insert but prevent relative rotational movement. While a bulkhead connector is disclosed in the present example, the present invention may be advantageously applied to other connectors as well.

An important advantage of the present invention is that the center conductor 90 of the cable 12 is prevented from rotating when a mating connector is installed, even when the mating connector is of the type having an integrally molded attaching nut. This prevents damage to the crimped connection with the cable conductor. Additionally, when the contact 56 is inserted into the hole 54, the end portions will already be in alignment with two channels 64 or will be automatically cammed into alignment by the bevels on the ends of the ribs 62 so that the contact is quickly and easily inserted into the connector during assembly by a relatively unskilled worker.

We claim:

1. An electrical connector comprising:

(a) a housing having a cavity therein;

(b) an insulating insert in said cavity, said insert having a longitudinal axis and an opening therethrough substantially coaxial with said axis; and (c) a contact adapted to be connected to the conductor of a cable, said contact arranged to be received within said opening in any of a plurality of angular positions, wherein said contact is inhibited from rotational movement with respect to said insert yet free to move axially along said axis.

2. The connector according to claim 1 wherein said housing includes a projection extending into said cavity and engages said insert and prevents rotational movement thereof with respect to said housing.

3. The connector according to claim 2 wherein said opening of said insert includes a plurality of angularly spaced ribs extending radially into said opening substantially parallel with said axis, thereby forming a plurality of channels, one channel being between each pair of adjacent ribs, and said contact includes a first edge portion that extends within one of said channels thereby effecting said rotational coupling of said contact to said insert.

4. The connector according to claim 3 wherein said contact includes a second edge portion that extends within another one of said channels substantially opposite said one channel.

5. The connector according to claim 4 wherein said first and second edge portions extend into their respective channels with sufficient clearance to effect said free axial movement of said contact with respect to said housing.

6. The connector according to claim 3 wherein said contact includes a contact portion for electrically engaging a mating contact and a crimping portion for crimping onto said conductor of said cable, wherein said first edge portion is between said contact portion and said crimping portion.

7. The connector according to claim 3 wherein said connector is a coaxial connector.

* * * * *